US009282812B2

(12) United States Patent
Chang

(10) Patent No.: US 9,282,812 B2
(45) Date of Patent: Mar. 15, 2016

(54) ANTI-UNFOLDING LEG ASSEMBLY FOR FOLDABLE TABLE

(71) Applicant: Mei-Fang Chang, Kowloon (HK)

(72) Inventor: Mei-Fang Chang, Kowloon (HK)

( * ) Notice: Subject to any disclaimer, the term of this patent is extended or adjusted under 35 U.S.C. 154(b) by 0 days.

(21) Appl. No.: 14/260,243

(22) Filed: Apr. 23, 2014

(65) Prior Publication Data

US 2015/0305490 A1 Oct. 29, 2015

(51) Int. Cl.

| | |
|---|---|
| ***A47B 3/00*** | (2006.01) |
| ***A47B 3/08*** | (2006.01) |
| *A47B 13/02* | (2006.01) |

(52) U.S. Cl.

CPC ..... *A47B 3/0818* (2013.01); *A47B 3/002* (2013.01); *A47B 3/08* (2013.01); *A47B 13/02* (2013.01)

(58) Field of Classification Search

CPC ..... A47B 3/002; A47B 3/02; A47B 3/08; A47B 13/02; A47B 2003/002; A47B 2003/08; A47B 2013/02; A47B 3/083; A47B 3/087; A47B 3/091

See application file for complete search history.

(56) References Cited

U.S. PATENT DOCUMENTS

| | | | | |
|---|---|---|---|---|
| 2003/0217676 | A1* | 11/2003 | Strong et al. | 108/127 |
| 2005/0061214 | A1* | 3/2005 | Tsai | 108/132 |
| 2005/0103239 | A1* | 5/2005 | Neunzert et al. | 108/132 |
| 2007/0012228 | A1* | 1/2007 | Tsai | 108/126 |
| 2009/0078173 | A1* | 3/2009 | Topham et al. | 108/77 |
| 2010/0170423 | A1* | 7/2010 | Chang | 108/167 |
| 2011/0203494 | A1* | 8/2011 | Ashby et al. | 108/127 |
| 2013/0025509 | A1* | 1/2013 | Jin et al. | 108/166 |
| 2013/0233210 | A1* | 9/2013 | Jin et al. | 108/166 |
| 2014/0116301 | A1* | 5/2014 | Tsai | 108/169 |
| 2014/0345506 | A1* | 11/2014 | Clegg et al. | 108/169 |

* cited by examiner

*Primary Examiner* — Daniel Rohrhoff

(74) *Attorney, Agent, or Firm* — Raymond Y. Chan; David and Raymond Patent Firm

(57) ABSTRACT

An anti-folding leg assembly for a tabletop includes a leg frame for pivotally coupling at a bottom side of the tabletop to pivotally move between a folded position and an unfolded position, and an anti-folding arrangement including a table support having has a table coupling end adapted for pivotally coupling at the bottom side of the tabletop, and a leg support having a leg coupling end pivotally coupled at the leg frame. A pivot point is defined at a pivot connection between the table support and the leg support, and a centerline is defined between the table coupling end of the table support and the leg coupling end of the leg support when the leg frame is moved in the unfolded position, wherein the pivot point is located below the centerline when the leg frame is moved in the unfolded position.

22 Claims, 4 Drawing Sheets

ANTI-UNFOLDING LEG ASSEMBLY FOR FOLDABLE TABLE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a foldable table, and more particular to an anti-folding leg assembly for a foldable table, which can prevent the leg assembly to be accidentally folded back to its folded position once it is unfolded.

2. Description of Related Arts

Foldable tables, such as banquet tables, have become very popular since the tables are economy, cheap and foldable that can be quickly and easily folded for carriage and storage and unfolded for use. Especially when some participant-intensive activities take place in multi-function rooms or designated areas, the foldable tables can be temporary set up in minutes. After the functions, the foldable tables can be quickly and neatly folded up for storage. However, the foldable tables cannot be stacked with each other.

Generally speaking, the foldable table comprises a tabletop and a leg assembly pivotally coupled at a bottom side of the tabletop. In particular, the leg assembly comprises two leg frames pivotally coupled at two transverse sides of the tabletop at the bottom side thereof respectively. Therefore, each of the leg frames can be pivotally folded to rest on the bottom side of the tabletop at its folded position and can be pivotally folded to perpendicular to the tabletop at its unfolded position. However, the major drawback of the conventional foldable table is that the leg frame can be pivotally folded back from the unfolded position to the folded position easily. As a result, the foldable table cannot provide sufficient rigidity to support the load on the tabletop because of the wobbling leg frame at the unfolded position.

In order to retain the leg frame in the unfolded position, the leg assemble further comprises two support members extended from the bottom side of the tabletop to the leg frames respectively. Each of the support members may include a first brace pivotally extended from the bottom side of the tabletop and a second brace pivotally extended from the respective leg frame, wherein the first and second braces are pivotally coupled with each other end-to-end, such that when the leg frame is folded at the unfolded position, the first and second braces are aligned with each other to form a straight support member. In other words, the bottom side of the tabletop, the leg frame, and the support member form a triangular configuration to retain the leg frame in the unfolded position.

Since the support members are located underneath the tabletop which is the leg room of the foldable table, the user may accidentally kick the support member to unfold the support member. As a result, there is no reinforcement for the existing foldable table to ensure the leg assembly to be retained at the unfolded position.

SUMMARY OF THE PRESENT INVENTION

The invention is advantageous in that it provides an anti-folding leg assembly for a foldable table, which can prevent the leg assembly to be accidentally folded back to its folded position once it is unfolded.

Another advantage of the invention is to an anti-folding leg assembly for a foldable table, which help secure the leg assemble in the unfolded position and facilitate the folding movement of the leg assembly between the folded and unfolded position.

Another advantage of the invention is to an anti-folding leg assembly for a foldable table, which provides a simple geometrical configuration of the leg assembly to solve the existing problem of the leg assembly.

Another advantage of the invention is to an anti-folding leg assembly for a foldable table, wherein the leg assembly can be quickly folded between the folded and unfolded positions as the conventional leg assembling structure. In other words, the user is able to fold or unfold the leg assembly of the present invention with the same operation of the existing leg assembly.

Another advantage of the invention is to an anti-folding leg assembly for a foldable table, which does not require to alter the original structural design of the foldable table, so as to minimize the manufacturing cost of the foldable table incorporating with the anti-folding leg assembly.

Another advantage of the invention is to an anti-folding leg assembly for a foldable table, wherein no expensive or complicated structure is required to employ in the present invention in order to achieve the above mentioned objects. Therefore, the present invention successfully provides an economic and efficient solution for providing a rigid configuration for the foldable table and for preventing the leg assembly being unfolded unintentionally.

Additional advantages and features of the invention will become apparent from the description which follows, and may be realized by means of the instrumentalities and combinations particular point out in the appended claims.

According to the present invention, the foregoing and other objects and advantages are attained by an anti-folding leg assembly for a tabletop, wherein the anti-folding leg assembly comprises a leg frame and an anti-folding arrangement.

The leg frame is arranged for pivotally coupling at a bottom side of the tabletop to pivotally move between a folded position and an unfolded position.

The anti-folding arrangement is arranged for retaining said leg frame in said unfolded position. The anti-folding arrangement comprises a table support having has a table coupling end adapted for pivotally coupling at the bottom side of the tabletop, and a leg support having a leg coupling end pivotally coupled at the leg frame. A pivot point is defined at a pivot connection between the table support and the leg support, and a centerline is defined between the table coupling end of the table support and the leg coupling end of the leg support when the leg frame is moved in the unfolded position.

The pivot point is located below the centerline when the leg frame is moved in the unfolded position.

The folding angle of the anti-folding arrangement is defined between the table support and the leg support, wherein the folding angle is greater than 180° when the leg frame is moved from the folded position to the unfolded position.

In accordance with another aspect of the invention, the present invention comprises a foldable table which comprises a tabletop, a leg frame, and an anti-folding arrangement.

The leg frame is arranged for pivotally coupling at a bottom side of the tabletop to pivotally move between a folded position and an unfolded position.

The anti-folding arrangement is arranged for retaining said leg frame in said unfolded position. The anti-folding arrangement comprises a table support having has a table coupling end adapted for pivotally coupling at the bottom side of the tabletop, and a leg support having a leg coupling end pivotally coupled at the leg frame. The table support and the leg support are pivotally coupled with each other and define a folding angle of the anti-folding arrangement greater than 180° when the leg frame is moved from the folded position to the unfolded position.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
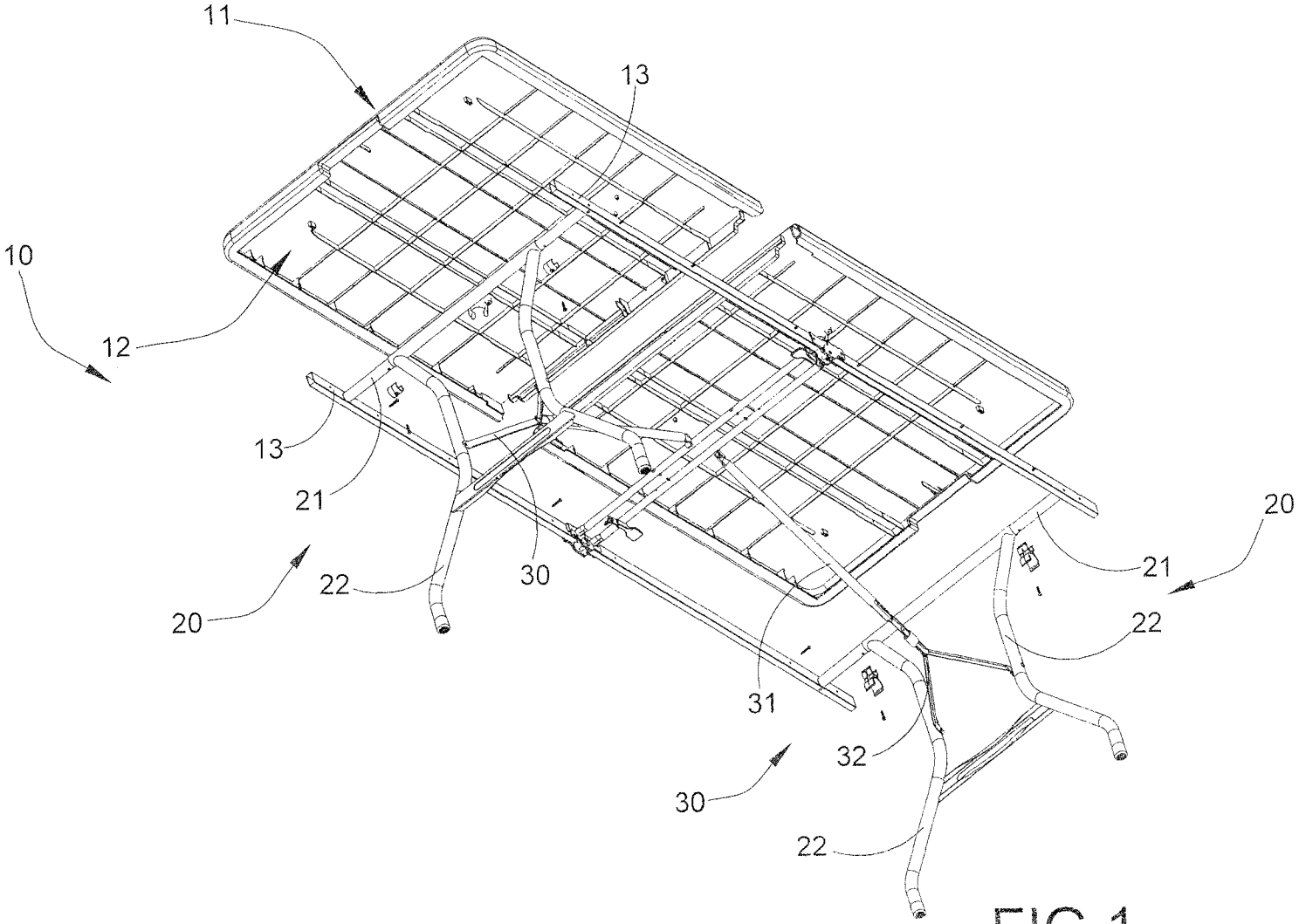
FIG. 1 is a perspective view of a foldable table with an anti-folding leg assembly according to a preferred embodiment of the present invention.
Figure 2:
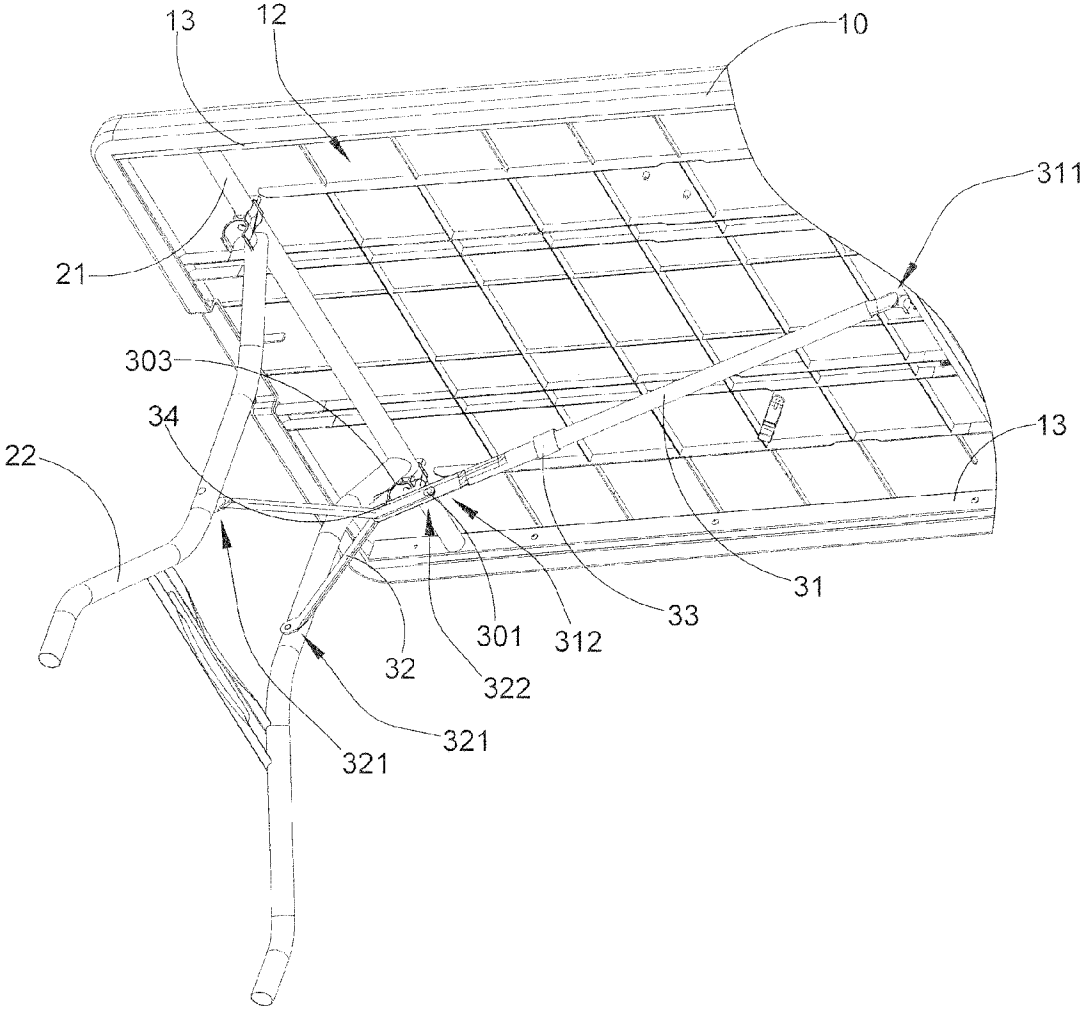
FIG. 2 is a perspective view of the anti-folding leg assembly according to the above preferred embodiment of the present invention, illustrating the leg frame in a folded position.
Figure 3:
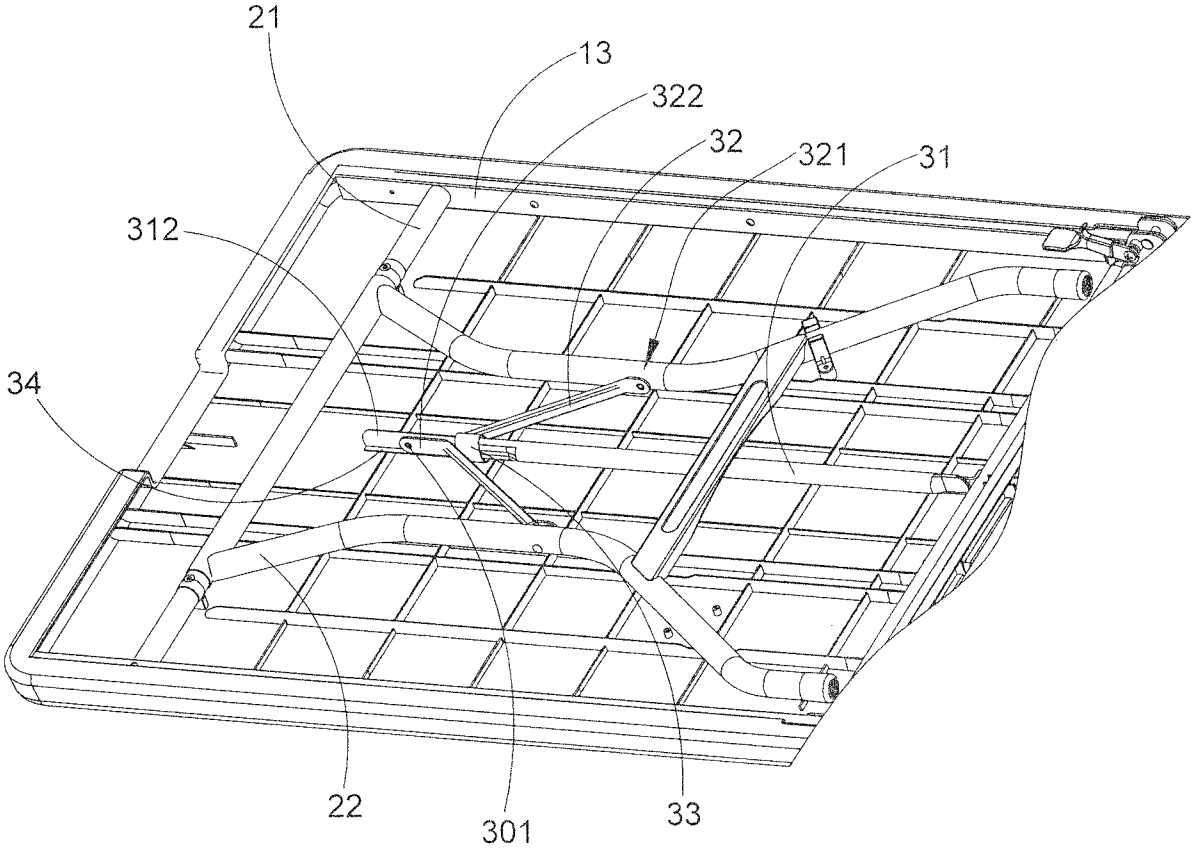
FIG. 3 is a perspective view of the anti-folding leg assembly according to the above preferred embodiment of the present invention, illustrating the leg frame in an unfolded position.

Referring to FIGS. 1 to 3 of the drawings, a foldable table according to a preferred embodiment of the present invention is illustrated, wherein the foldable table, which is a banquet table, comprises a tabletop 10, at least a leg frame 20 and at least an anti-folding arrangement 30.

The tabletop 10, according to the preferred embodiment, is an injection mold tabletop having a top side 11 and a bottom side 12, wherein two runners 13 are extended along two longitudinal sides of the tabletop 10 at the bottom side 12 thereof. It is appreciated that the tabletop 10 can be made of rigid material such as wood or other materials. Preferably, the two runners 13 are embedded at the bottom side 12 of the tabletop 10 when the tabletop 10 is made of plastic by mold injection process.

The leg frame 20 is pivotally coupled at the bottom side 12 of the tabletop 10 to pivotally move between a folded position and an unfolded position. As shown in FIG. 1, two leg frames 20 are pivotally coupled at two transverse sides of the tabletop 10 at the bottom side 12 thereof. In the folded position, each of the leg frames 20 is pivotally and upwardly moved to rest on the bottom side 12 of the tabletop 10, as shown in FIG. 2. In the unfolded position, each of the leg frames 20 is pivotally and downwardly moved from the bottom side 12 of the tabletop 10 to transversely extend from the bottom side 12 of the tabletop 10, as shown in FIG. 3.

Preferably, each of the leg frames 20 comprises a transverse member 21 rotatably extended between the two runners 13 at a position below the bottom side 12 of the tabletop 10, and a leg member 22 extended from the transverse member 21, such that the leg member 22 is moved to rest on the bottom side 12 of the tabletop 10 in the folded position by the rotational movement of the transverse member 21 with respect to the runners 13. The leg member 22 is also moved to transversely extend from the bottom side 12 of the tabletop 10 in the unfolded position by the rotational movement of the transverse member 21 with respect to the runners 13. It is appreciated that the leg frames 20 can be directly mounted at the bottom side 12 of the tabletop 10 via a conventional pivot joint in order to enable the leg frames 20 to be pivotally moved between the folded position and the unfolded position.

The anti-folding arrangement 30 is arranged for retaining the leg frame 20 in the unfolded position. Accordingly, the anti-folding arrangement 30 is incorporated with each leg frame 20, such that when two leg frames 20 are presented, two anti-folding arrangements 30 will be incorporated with the leg frames 20 respectively.

Figure 4:
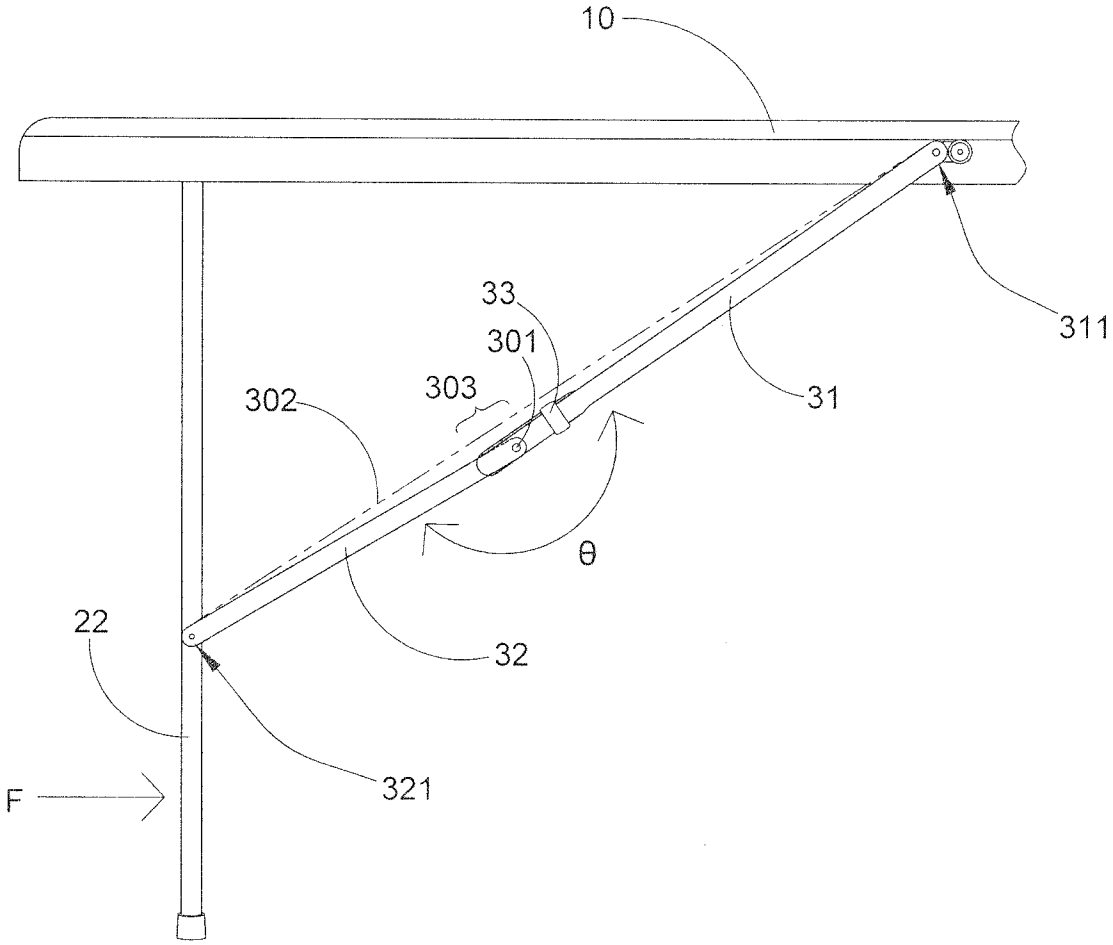
FIG. 4 is a side view of the anti-folding leg assembly according to the above preferred embodiment of the present invention, illustrating the pivot point located below the centerline of the anti-folding arrangement.

As shown in FIGS. 2 to 4, the anti-folding arrangement 30 comprises a table support 31 having has a table coupling end 311 pivotally coupled at the bottom side 12 of the tabletop 10, and a leg support 32 having a leg coupling end 321 pivotally coupled at the leg frame 20. The table support 31 and the leg support 32 are pivotally coupled with each other to define a pivot point 301.

In particular, the table support 31 is an elongated brace pivotally extended from the bottom side 12 of the tabletop 10, wherein the table support 31 further has a first pivot end portion 312 extended opposite to the table coupling end 311. Accordingly, the table coupling end 311 of the table support 31 can be directly mounted to the bottom side 12 of the tabletop 10 or can be pivotally mounted to a transverse support 14 transversely supported between the two runners 13 at the mid-portion of the bottom side 12 of the tabletop 10.

The leg support 32, preferably formed in a Y-shaped configuration, defines two leg coupling ends 321 pivotally coupled at the leg frame 20, and further has a second pivot end portion 322 extended opposite to the leg coupling end 321. Accordingly, the first and second pivot end portions 312, 322 of the table support 31 and the leg support 32 are pivotally coupled with each other to define the pivot point 301 at a pivot connection between the table support 31 and the leg support 32. Furthermore, a centerline 302 is defined at a straight line between the table coupling end 311 of the table support 31 and the leg coupling end 321 of the leg support 32 when the leg frame 20 is moved in the unfolded position. In other words, the centerline 302 is defined at the shortest distance between the table coupling end 311 of the table support 31 and the leg coupling end 321 of the leg support 32 when the leg frame 20 is moved in the unfolded position.

As shown in FIG. 3, the first and second pivot end portions 312, 322 of the table support 31 and the leg support 32 are overlapped with each other to define an overlapped section 303 where the pivot point 301 is located.

According to the preferred embodiment, a folding angle θ is defined between the table support 31 and the leg support 32 corresponding to the pivotally folding movement of the leg frame 20.

When the leg frame 20 is moved in the folded position, the table support 31 is pivotally moved to rest on the bottom side 12 of the tabletop 10 that the pivot point 301 is moved toward the bottom side 12 of the tabletop 10. As a result, the leg support 32 is also moved to rest on the bottom side 12 of the tabletop 10 corresponding to the pivotal movement of the table support 31. When the leg frame 20 is moved in the folded position, the leg coupling end 321 of the leg support 32 is located between the pivot point 301 and the table coupling end 311 of the table support 31. Therefore, the table support 31 and the leg support 32 will be aligned at the same planner direction with respect to the bottom side 12 of the tabletop 10. As a result, the folding angle θ is defined between the table support 31 and the leg support 32 is zero degree when the leg frame 20 is moved at the folded position.

When the leg frame 20 is moved in the unfolded position, the table support 31 is pivotally moved to inclinedly and downwardly extend from the bottom side 12 of the tabletop 10 that the pivot point 301 is downwardly moved away from the bottom side 12 of the tabletop 10. As a result, the leg support 32 is also moved to inclinedly and upwardly extend from the leg frame 20 corresponding to the pivotal movement of the table support 31. When the leg frame 20 is moved in the unfolded position, the pivot point 301 is located between the leg coupling end 321 of the leg support 32 and the table coupling end 311 of the table support 31. The folding angle θ is defined between the table support 31 and the leg support 32 is greater than 180° when the leg frame 20 is moved at the unfolded position. As a result, the table support 31 is extended from the leg support 32 in a non-linear manner when the leg frame 20 is moved in the unfolded position. In other words, the table support 31 is not alignedly extended from the leg support 32 in a straight line manner when the leg frame 20 is moved in the unfolded position.

In other words, when the leg frame 20 is moved in the unfolded position, the pivot point 301 is located below the centerline 302 between the table coupling end 311 of the table support 31 and the leg coupling end 321 of the leg support 32.

It is worth mentioning that when the leg frame 20 is moved from the unfolded position back to the folded position, the pivot point 301 must be lifted up to the centerline 302 before the pivot point 301 is moved to the bottom side 12 of the tabletop 10. Therefore, the non-linear configuration of the anti-folding arrangement 30 will lock up the leg frame 20 in the unfolded position. Especially when a sideward force F is applied at the outer side of the leg frame 20, as shown in FIG. 4, the sideward force F cannot push the leg frame 20 inwardly to move the leg frame 20 from the unfolded position to the folded position. It is because the sideward force F cannot lift the pivot point 301 up to the centerline 302. As a result, the anti-folding arrangement 30 can substantially prevent the folding movement of the leg frame 20 once the leg frame 20 is moved in the unfolded position. On the other hand, the leg frame 20 can easily moved from the folded position to the unfolded position by pivotally pulling the leg frame 20 from the bottom side 12 of the tabletop 10.

As shown in FIG. 3, the anti-folding arrangement 30 further comprises a locker 33 slidably coupled at the table support 31 and arranged to slide at the overlapped section 303 to lock up the table support 31 with the leg support 32 when the leg frame 20 is moved in the unfolded position. According to the preferred embodiment, the locker 33 is a tubular member having an inner circumferential size larger than an outer circumferential size of the table support 31. Therefore, when the locker 33 is slid toward the table coupling end 311 of the table support 31, i.e. sliding away from the overlapped section 303, the table support 31 can be pivotally moved with respect to the leg support 32 in order to move the leg frame 20 from the unfolded position to the folded position. Once the locker 33 is slid at the overlapped section 303, the table support 31 cannot be pivotally moved with respect to the leg support 32 so as to lock up the leg frame 20 in the unfolded position.

The anti-folding arrangement 30 further comprises a blocking member 34 integrally and sidewardly extended from a top edge of the table support 31 to form a L-shaped cross sectional blocking portion to block a further pivotal movement of the leg support 32 when the leg frame 20 is moved in the unfolded position. According to the preferred embodiment, the blocking member 34 is integrally extended from the first pivot end portion 312 of the table support 31 at the top edge thereof. When the leg frame 20 is moved in the unfolded position, the second pivot end portion 322 of the leg support 32 will be biased against the blocking member 34 so as to restrict any further pivotal movement of the leg support 32 with respect to the table support 31.

It is appreciated that the blocking member 34 can be integrally and sidewardly extended from a bottom edge of the leg support 32 to form a L-shaped cross sectional blocking portion to block a further pivotal movement of the table support 31 when the leg frame 20 is moved in the unfolded position. In other words, the blocking member 34 can be integrally extended from the second pivot end portion 322 of the leg support 32 at the bottom edge thereof. When the leg frame 20 is moved in the unfolded position, the first pivot end portion 312 of the table support 31 will be biased against the blocking member 34 so as to restrict any further pivotal movement of the table support 31 with respect to the leg support 32.

In order to move the leg frame 20 from the folded position to the unfolded position, the user is able to pivotally pull the leg frame 20 from the bottom side 12 of the tabletop 10 until the leg frame 20 is transversely extended from the bottom side 12 of the tabletop 10. For restricting of the leg frame 20 to be moved back to the folded position, the user is able to apply a downward force at the pivot point 301 of the anti-folding arrangement 30 to ensure the pivot point 301 to be located below the centerline 302. At the same time, the second pivot end portion 322 of the leg support 32 will be biased against the blocking member 34 so as to restrict any further pivotal movement of the leg support 32 with respect to the table support 31. Then, the user to able to slide the locker 33 at the overlapped section 303, such that the table support 31 cannot be pivotally moved with respect to the leg support 32 so as to lock up the leg frame 20 in the unfolded position. In other words, the anti-folding arrangement 30 provides double locking structures to prevent the leg frame 30 being moved back from the unfolded position to the folded position.

In order to move the leg frame 30 back to the folded position from the unfolded position, the user is able to slide the locker 33 away from the overlapped section 303 in order to unlock the pivotal movement between the table support 31 and the leg support 32. Then, the user is able to apply an upward force at the pivot point 301 to move the pivot point 301 toward the centerline 302. Once the pivot point 301 passes the centerline 302, the leg frame 20 can be pivotally moved to rest on the bottom side 12 of the tabletop 10 so as to fold up the leg frame 20.

It is appreciated that the anti-folding leg assembly of the present invention can be incorporated with any existing foldable table having the tabletop 10. In addition, it is appreciated that the anti-folding arrangement of the present invention can be incorporated with any existing foldable table having the tabletop 10 and the leg frame 20 capable of being moved between the folded position and the unfolded position.

For example, the anti-folding leg assembly of the present invention can be incorporated with the wall supported type foldable table, wherein the tabletop 10 has a transverse edge pivotally coupled at the wall surface via a pivot hinge, wherein the leg frame 20 is pivotally coupled at the bottom side 12 of the tabletop 10 and the anti-folding arrangement 30 is extended between the leg frame 20 and the bottom side 12 of the tabletop 10. Therefore, when the leg frame 20 is moved at the folded position, the tabletop 10 can be pivotally and downwardly folded on the wall surface. When the leg frame 20 is moved at the unfolded position, the tabletop 10 can be pivotally and upwardly folded to transversely extend from the wall surface. In other words, only one leg frame 20 and one anti-folding arrangement 30 are incorporated with the wall support type folding table.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An anti-folding leg assembly for a foldable table having a tabletop, comprising:

at least a leg frame adapted for pivotally coupling at a bottom side of said tabletop to pivotally move between a folded position and an unfolded position; and at least an anti-folding arrangement for retaining said leg frame in said unfolded position, wherein said anti-folding arrangement comprises a table support having a table coupling end adapted for pivotally coupling at said bottom side of said tabletop, and a leg support having a leg coupling end pivotally coupled at said leg frame, wherein said table support and said leg support are pivotally coupled with each other and define a folding angle of said anti-folding arrangement greater than 180° to form a non-linear configuration of said anti-folding arrangement when said leg frame is moved from said folded position to said unfolded position.

2. The anti-folding leg assembly, as recited in claim 1, wherein said table support further has a first pivot end portion extended opposite to said table coupling end, and said leg support further has a second pivot end portion extended opposite to said leg coupling end, wherein said first and second pivot end portions of said table support and said leg support are pivotally coupled with each other to define a pivot point and said folding angle between said table support and said leg support.

3. The anti-folding leg assembly, as recited in claim 2, wherein said first and second pivot end portions of said table support and said leg support are overlapped with each other to define an overlapped section where said pivot point is located.

4. The anti-folding leg assembly, as recited in claim 3, wherein said anti-folding arrangement further comprises a locker slidably coupled at said table support and arranged to slide at said overlapped section to lock up said table support with said leg support.

5. The anti-folding leg assembly, as recited in claim 4, wherein said table support is extended from said leg support in a non-linear manner when said leg frame is moved in said unfolded position.

6. The anti-folding leg assembly, as recited in claim 5, wherein said anti-folding arrangement further comprises a blocking member integrally and sidewardly extended from a top edge of said table support to form a L-shaped cross sectional blocking portion to block a further pivotal movement of said leg support when said leg frame is moved in said unfolded position.

7. The anti-folding leg assembly, as recited in claim 1, wherein said table support is extended from said leg support in a non-linear manner when said leg frame is moved in said unfolded position.

8. The anti-folding leg assembly, as recited in claim 1, wherein said anti-folding arrangement further comprises a blocking member integrally and sidewardly extended from a top edge of said table support to form a L-shaped cross sectional blocking portion to block a further pivotal movement of said leg support when said leg frame is moved in said unfolded position.

9. An anti-folding arrangement for a foldable table having a tabletop and a leg frame pivotally coupled at a bottom side of said tabletop to pivotally move between a folded position and an unfolded position, wherein said anti-folding arrangement comprises:

a table support having has a table coupling end adapted for pivotally coupling at said bottom side of said tabletop; and a leg support having a leg coupling end adapted for pivotally coupling at said leg frame, wherein said table support and said leg support are pivotally connected with each other to define a pivot point and a centerline between said table coupling end of said table support and said leg coupling end of said leg support when said leg frame is moved in said unfolded position, wherein said pivot point is located below said centerline to form a non-linear configuration of said anti-folding arrangement when said leg frame is moved in said unfolded position.

10. The anti-folding arrangement, as recited in claim 9, wherein said table support further has a first pivot end portion extended opposite to said table coupling end, and said leg support further has a second pivot end portion extended opposite to said leg coupling end, wherein said first and second pivot end portions of said table support and said leg support are pivotally coupled with each other to define said pivot point.

11. The anti-folding arrangement, as recited in claim 10, wherein said anti-folding arrangement further comprises a locker slidably coupled at said table support, wherein said first and second pivot end portions of said table support and said leg support are overlapped with each other to define an overlapped section where said pivot point is located, wherein said locker is slid at said overlapped section to lock up said table support with said leg support.

12. The anti-folding arrangement, as recited in claim 11, wherein said table support is extended from said leg support in a non-linear manner when said leg frame is moved in said unfolded position.

13. The anti-folding arrangement, as recited in claim 12, wherein said anti-folding arrangement further comprises a blocking member integrally and sidewardly extended from a top edge of said table support to form a L-shaped cross sectional blocking portion to block a further pivotal movement of said leg support when said leg frame is moved in said unfolded position.

14. The anti-folding arrangement, as recited in claim 9, wherein said table support is extended from said leg support in a non-linear manner when said leg frame is moved in said unfolded position.

15. The anti-folding arrangement, as recited in claim 9, wherein said anti-folding arrangement further comprises a blocking member integrally and sidewardly extended from a top edge of said table support to form a L-shaped cross sectional blocking portion to block a further pivotal movement of said leg support when said leg frame is moved in said unfolded position.

16. A foldable table, comprising:

a tabletop having a bottom side;

at least a leg frame pivotally coupled at said bottom side of said tabletop to pivotally move between a folded position and an unfolded position; and at least an anti-folding arrangement for retaining said leg frame in said unfolded position, wherein said anti-folding arrangement comprises a table support having a table coupling end pivotally coupled at said bottom side of said tabletop, and a leg support having a leg coupling end pivotally coupled at said leg frame, wherein said anti-folding arrangement has a pivot point defined at a pivot connection between said table support and said leg support, and a centerline between said table coupling end of said table support and said leg coupling end of said leg support when said leg frame is moved in said unfolded position, wherein said pivot point is located below said centerline to form a non-linear configuration of said anti-folding arrangement when said leg frame is moved in said unfolded position.

17. The foldable table, as recited in claim 16, wherein said table support further has a first pivot end portion extended opposite to said table coupling end, and said leg support further has a second pivot end portion extended opposite to said leg coupling end, wherein said first and second pivot end portions of said table support and said leg support are pivotally coupled with each other to define said pivot point.

18. The foldable table, as recited in claim 17, wherein said anti-folding arrangement further comprises a locker slidably coupled at said table support, wherein said first and second pivot end portions of said table support and said leg support are overlapped with each other to define an overlapped section where said pivot point is located, wherein said locker is slid at said overlapped section to lock up said table support with said leg support.

19. The foldable table, as recited in claim 18, wherein said table support is extended from said leg support in a non-linear manner when said leg frame is moved in said unfolded position.

20. The foldable table, as recited in claim 19, wherein said anti-folding arrangement further comprises a blocking member integrally and sidewardly extended from a top edge of said table support to form a L-shaped cross sectional blocking portion to block a further pivotal movement of said leg support when said leg frame is moved in said unfolded position.

21. The foldable table, as recited in claim 16, wherein said table support is extended from said leg support in a non-linear manner when said leg frame is moved in said unfolded position.

22. The foldable table, as recited in claim 16, wherein said anti-folding arrangement further comprises a blocking member integrally and sidewardly extended from a top edge of said table support to form a L-shaped cross sectional blocking portion to block a further pivotal movement of said leg support when said leg frame is moved in said unfolded position.

* * * * *